US006561240B2

(12) United States Patent
Ma

(10) Patent No.: US 6,561,240 B2
(45) Date of Patent: May 13, 2003

(54) PURSE ORGANIZER

(76) Inventor: Agnes Ma, 34596 Calcutta Dr., Fremont, CA (US) 94555-3106

( * ) Notice: Subject to any disclaimer, the term of this patent is extended or adjusted under 35 U.S.C. 154(b) by 0 days.

(21) Appl. No.: 09/928,876

(22) Filed: Aug. 13, 2001

(65) Prior Publication Data

US 2003/0029534 A1 Feb. 13, 2003

(51) Int. Cl.[7] ..... A45C 1/02; A45C 3/06; A45C 13/02

(52) U.S. Cl. ..... 150/104; 150/113; 190/110

(58) Field of Search ..... 150/101, 102, 150/103–106, 111–117; 224/901, 901.2; 190/109, 110

(56) References Cited

U.S. PATENT DOCUMENTS

| | | | | | |
|---|---|---|---|---|---|
| 2,183,428 | A | | 12/1939 | McNary | 150/113 X |
| 2,464,312 | A | | 3/1949 | Holden | 150/113 |
| 2,604,917 | A | * | 7/1952 | Reilly | 150/111 |
| 2,893,457 | A | * | 7/1959 | Wilson | 150/113 X |
| 3,451,454 | A | * | 6/1969 | Davis | 150/113 |
| 3,491,909 | A | * | 1/1970 | Ikelheimer | 190/109 X |
| 3,964,529 | A | | 6/1976 | Brod | |
| 4,177,909 | A | | 12/1979 | Haskell | |
| 4,210,186 | A | * | 7/1980 | Belenson | 190/110 X |
| 4,250,938 | A | | 2/1981 | Siegel | 150/103 X |
| 4,263,951 | A | * | 4/1981 | Siegel | 150/113 X |
| 4,532,972 | A | | 8/1985 | Sinsko | 150/106 X |
| 4,610,286 | A | * | 9/1986 | Cyr | 190/110 X |
| 4,842,032 | A | * | 6/1989 | Mastronardo | 150/113 X |
| 4,991,980 | A | | 2/1991 | Cohen et al. | 383/40 |
| 4,995,436 | A | | 2/1991 | Cantor | 150/113 X |
| 5,024,361 | A | * | 6/1991 | Flowers | 383/39 X |
| 5,911,262 | A | | 6/1999 | Steinhart | 150/103 |
| 5,983,969 | A | * | 11/1999 | Morgan | 150/113 X |
| 6,095,213 | A | | 8/2000 | Roegner | 150/106 |

FOREIGN PATENT DOCUMENTS

| | | | | |
|---|---|---|---|---|
| FR | 2653312 | * | 4/1991 | 190/110 |

* cited by examiner

*Primary Examiner*—Sue A. Weaver
(74) *Attorney, Agent, or Firm*—Michael I. Kroll

(57) ABSTRACT

Disclosed is an organizer for use in a handbag having one or more detachable hook and loop strips 20 and a non-detachable, mating sheets 24 for selectively supporting the strips 20 within the organizer. The non-detachable, mating sheets 24 for the dividers 20 are at least two lengths of hook and loop material 24 which, having an adhesive back, are adhesively positioned adjacent each other on opposing internal walls of the purse 10. The hook and loop material 24 may also be sewn into place. The hook and loop strips 20, 24 can be of any length preferably extending substantially from the base to the top of the purse wall. By incorporating one or more partitioning elements 20 organizer can be divided into a plurality of compartments 22 of varying size.

1 Claim, 8 Drawing Sheets

PURSE ORGANIZER

BACKGROUND OF THE INVENTION

1. Field of the Invention

The present invention relates generally to insertable purse organizers and more specifically to a purse organizer with selectively positionable vertical partitioning elements. The purse organizer of the present invention consists of one or more partitions and a means for selectively maintaining the positioning within a container, preferably a purse, handbag or carryall, hereinafter collectively referred to as a purse. The maintaining means for the dividers are at least two lengths of hook and loop material which, having an adhesive back, are adhesively positioned adjacent each other on opposing walls of the purse. At least one partitioning member is comprised of a length of suitable material having the mating element of hook and loop material fixedly positioned along the longitudinal edges of the partitioning element.

Partitioning elements can be of any length preferably extending substantially from the base to the top of the purse wall. By incorporating one or more partitioning elements and retaining means the purse can be divided into a plurality of compartments of varying size.

An additional element is provided wherein the purse organizer has spaced apart walls and a base with the partitioning retaining means fixedly positioned therein by any means such as adhesively or sewn to the interior walls thereof, whereby the partitioning elements can be selectively positioned between said retaining means. The purse organizer, having one or more partitions therein can be placed selectively placed with a purse.

The use of said purse organizer provides a means for dividing the purse into a plurality of compartments without modifications.

The present invention is portable, removable and fits within the interior of a purse and may carry such items as a cellular phone, calculator, wallet, check book, women's personal hygiene items and much more. It is the primary object of the present invention to provide an improved purse organizer with adjustable dividers for holding articles of different sizes securely that are readily accessible in an orgranized arrangement within a purse. The purse organizer provides the user with an organizational device in which loosely carried items may now be placed within various sized user designed compartments.

2. Description of the Prior Art

There are other handbag organizer devices. Typical of these is U.S. Pat. No. 2,183,428 issued to McNary on Dec. 12, 1939.

Another patent was issued to Holden on Mar. 15, 1949 as U.S. Pat. No. 2,464,312. Yet another U.S. Pat. No. 3,964,529 was issued to Brod on Jun. 22, 1976 and still yet another was issued on Dec. 11, 1979 to Haskell as U.S. Pat. No. 4,177,909.

Another patent was issued to Siegel on Feb. 17, 1981 as U.S. Pat. No. 4,250,938. Another patent was issued to Sinsko on Aug. 6, 1985 as U.S. Pat. No. 4,532,972. Another patent was issued to Cohen et al on Feb. 12, 1991 as U.S. Pat. No. 4,991,980. Another patent was issued to Cantor on Feb. 26, 1991 as U.S. Pat. No. 4,995,436. Another patent was issued to Steinhart on Jun. 15, 1999 as U.S. Pat. No. 5,911,262 and another patent was issued to Roegner on Aug. 1, 2000 as U.S. Pat. No. 6,095,213.

U.S. Pat. No. 2,183,428

Inventor: A. H. McNary

Issued: Dec. 12, 1939

In a purse kit, a substantially rigid backing, a pair of straps, one disposed on each outer side of said backing and each strap being secured to the backing at both ends to form oppositely located fixed loops for retaining articles in position against the backing on each side thereof, attachment means on each of said loops, and an auxiliary strap attached at one end to said backing and having attachment means at its free end for engagement with the attachment on either end of said fixed loops.

U.S. Pat. No. 2,464,312

Inventor: W. B. Holden

Issued: Mar. 15, 1949

A quick-change bag insert comprising a substantially rectangular body member formed of flexible material, said body member having its end portions folded toward the center of said body member and secured thereto along the edges of said body member to form open pockets, a stiffening member removably positioned in each of said pockets whereby said body member may be folded about its center portion to form upstanding side members, means for releasably closing said pockets for holding said stiffening elements therein while providing for removal of said stiffening elements to enable cleaning of said body member, said side members having elements of flexible material secured to the exposed surfaces of said body member to form a plurality of external pockets for receiving articles to be carried in said bag, said insert being shaped to be received within a handbag while carrying said articles and being transferable with its contained articles from one handbag to another.

U.S. Pat. No. 3,964,529

Inventor: William F. Brod

Issued: 3,964,529

A purse kit for assembling a purse employing an outside covering chosen and provided by the purchaser. The kit includes a pre-scored stiffening member about which the outside fabric is folded, a preformed liner which is adhesively secured about its perimeter to the folded edges of the covering fabric and stiffening member and suitable hardware cooperating with perforations in the liner to provide footrests and a closure fastener for the purse.

U.S. Pat. No. 4,177,909

Inventor: Lois O. Haskell

Issued: Dec. 11, 1979

A convertible purse having three major components which may be separately and selectively utilized and independently or collectively carried by the user. The convertible purse may take the form of a large tote bag which may be carried by means of a shoulder strap or by means of crossed straps as a knapsack; a handbag which is carried within a major compartment of the purse and which may be separated therefrom to independently serve as a handbag, the handbag having means thereon for carrying cosmetic pouches and storing the same in the major compartment of the purse; and a clutch purse carryable by the handbag and also receivable within the major compartment of the purse. Each of the major components, the purse, the handbag and the clutch purse, is provided with pockets and compartments for individually and selectively receiving items to be carried therein whereby the overall convertible purse is capable of receiving and carrying a large number of items normally used in traveling or the like.

U.S. Pat. No. 4,250,938

Inventor: Milton I. Siegel

Issued: Feb. 17, 1981

A ladies handbag having a main handbag component and a separate detachable organizer clutch purse component is disclosed. The clutch purse has an organizer section for the convenient reception and display of cosmetic items and attaches to the main handbag at a hinged rear flap, or, in another embodiment, is receivable in an inner pocket of the main handbag. In one embodiment the organizer clutch is provided with expandable loops which conveniently retain cosmetic accessories in place. A viewing slot in the organizer clutch permits the user identification and access to the contained items. The organizer clutch includes a closure flap carrying a make-up mirror.

U.S. Pat. No. 4,532,972

Inventor: George V. Sinsko

Issued: Aug. 6, 1985

A device is provided for facilitating the rapid location of items contained within a purse. The device is comprised of a panel of substantially rectangular configuration having a center portion and paired end strips. A number of releasable fasteners adapted to engage said end strips are each provided with a flexible tether line which can be attached to a specific item in the purse. Indicia on the panel correspond to the sought items in the purse. The panel is attached to a sidewall of the purse using rivets which penetrate the center portion of said panel.

U.S. Pat. No. 4,991,980

Inventor: Alden M. Cohen et al.

Issued: Feb. 12, 1991

There is disclosed herein a bag which is constructed to form a primary loading compartment and an auxiliary load-carrying or promotional-item-carrying pocket. The bag includes front, back, side and bottom panels and a compartment forming partition panel. The partition panel is secured to the front panel so as to define primary and auxiliary load-carrying compartments. The auxiliary compartment is formed by the front panel and partition panel. The front panel may be apertured and overlaid with a transparent film so as to form a window. The partition is adhered to the front panel so as to form a pocket in which the contents are positioned for viewing through the window.

U.S. Pat. No. 4,995,436

Inventor: Joseph L. Cantor

Issued: Feb. 26, 1991

A method and means of safely securing valuables in the form of a break-away handbag. Removable reattachable adjacent bag segments are mounted to each other by means of snaps, VELCRO or the like. One or more bag segments act as a decoy and are positioned facing out and away from the body of the handbag holder while other adjacently placed bag segments designed to hold valuables are positioned more proximate to or up against the handbag holder's body. A shoulder strap is attached to a decoy bag segment and is hung over the user's shoulder. Cavities created between each of the adjacent bag segments are capable of enveloping the handbag holder's hand. When an extraordinary pulling force is exerted upon a decoy bag segment or segments, they will separate from the adjacent valuables bag segment or segments and said valuables bag segment or segments will be retained against or between the handbag holder's hand and body.

U.S. Pat. No. 5,911,262

Inventor: Elyse A. Steinhart

Issued: Jun. 15, 1999

A new handbag for allowing a user to organize and store the contents of a purse so that the contents may be easily transferred between variously designed and colored handbags. The inventive device includes an inner handbag disposed within an outer handbag. The inner handbag includes an inner shell with front and rear storage flaps pivotally coupled thereto. The inner shell defines an inner compartment for holding items and the front and rear storage flaps have loops, pockets, and pouches for holding items such as cosmetics, credit cards, and checkbooks. The outer handbag includes an outer shell and a closure flap. The inner shell is disposed within the main compartment of the outer shell. The front storage flap is inserted through a front slot in the front panel of the outer shell.

Similarly, the rear storage flap is inserted through a rear slot in the rear panel of the outer shell.

U.S. Pat. No. 6,095,213

Inventor: DeAnna Roegner

Issued: Aug. 1, 2000

An organizing case for articles that can be carried as a clutch, or small shoulder bag, or in a purse. The carrying case comprises a generally rectangular primary panel having an inner and an outer face that is folded along a selected transverse line forming a front panel and a back panel with the inner face defining a primary receptacle. A pocket assembly and an inner mounting panel—having a mirror mounted on one face, and a plurality of attachment devices for detachably mounting a plurality of items are pivotally mounted inside the primary receptacle. A removable cover stowable in the case is shaped to envelop the case so that the case can be carried as a purse.

SUMMARY OF THE PRESENT INVENTION

The present invention discloses one or more detachable hook and loop strips and a non-detachable, mating means for selectively maintaining the detachable strips within a housing, such as a purse. The non-detachable, mating means for the detachable strips are at least two lengths of non-detachable hook and loop material which, having an adhesive back, are adhesively positioned adjacent each other on opposing internal walls of the purse. The non-detachable hook and loop material may also be sewn into the present invention. The hook and loop strips can be of any length preferably extending substantially from the base to the top of the purse wall. By incorporating one or more detachable partitioning elements and non-detachable retaining means the purse can be divided into a plurality of compartments of varying size.

A primary object of the present invention is to provide a purse organizer.

Another object of the present invention is to provide an organizer that can be inserted into a handbag.

Yet another object of the present invention is to provide a purse organizer that can be used by itself.

Still yet another object of the present invention is to provide a purse organizer having a plurality of compartments.

Another object of the present invention is to provide a purse organizer wherein the size of the compartments is user selectable.

Yet another object of the present invention is to provide a purse organizer having partition retaining means fixedly positioned on the interior walls of the purse organizer.

Still yet another object of the present invention is to provide a purse organizer having a hook and loop fastener as the partition retaining means.

Another object of the present invention is to provide a purse organizer having at least one partitioning element.

Yet another object of the present invention is to provide a purse organizer having partitioning element having mating hook and loop fastener fixedly positioned along the longitudinal edges of the partitioning element.

Still yet another object of the present invention is to provide a purse organizer having a plurality of partitioning elements.

Another object of the present invention is to provide means for partitioning a purse, handbag or carryall by adhesively positioning a length of hook and loop fastener material on opposing interior walls of the carryall and providing a plurality of partition elements having mating hook and loop material fixedly positioned along the longitudinal edge of the partitioning elements.

Additional objects of the present invention will appear as the description proceeds.

The present invention overcomes the shortcomings of the prior art by providing a purse organizer having spaced apart walls and a base with the partitioning retaining means fixedly positioned within said bag by any means known within the art, such as adhesively or sewn to the interior walls of said purse organizer, whereby the partitioning elements can be selectively positioned between said retaining means. The purse organizer, having one or more partitions therein can be placed selectively within a second purse, handbag or carryall.

The use of said purse organizer within a purse provides means for dividing the purse into a plurality of compartments without modifications.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
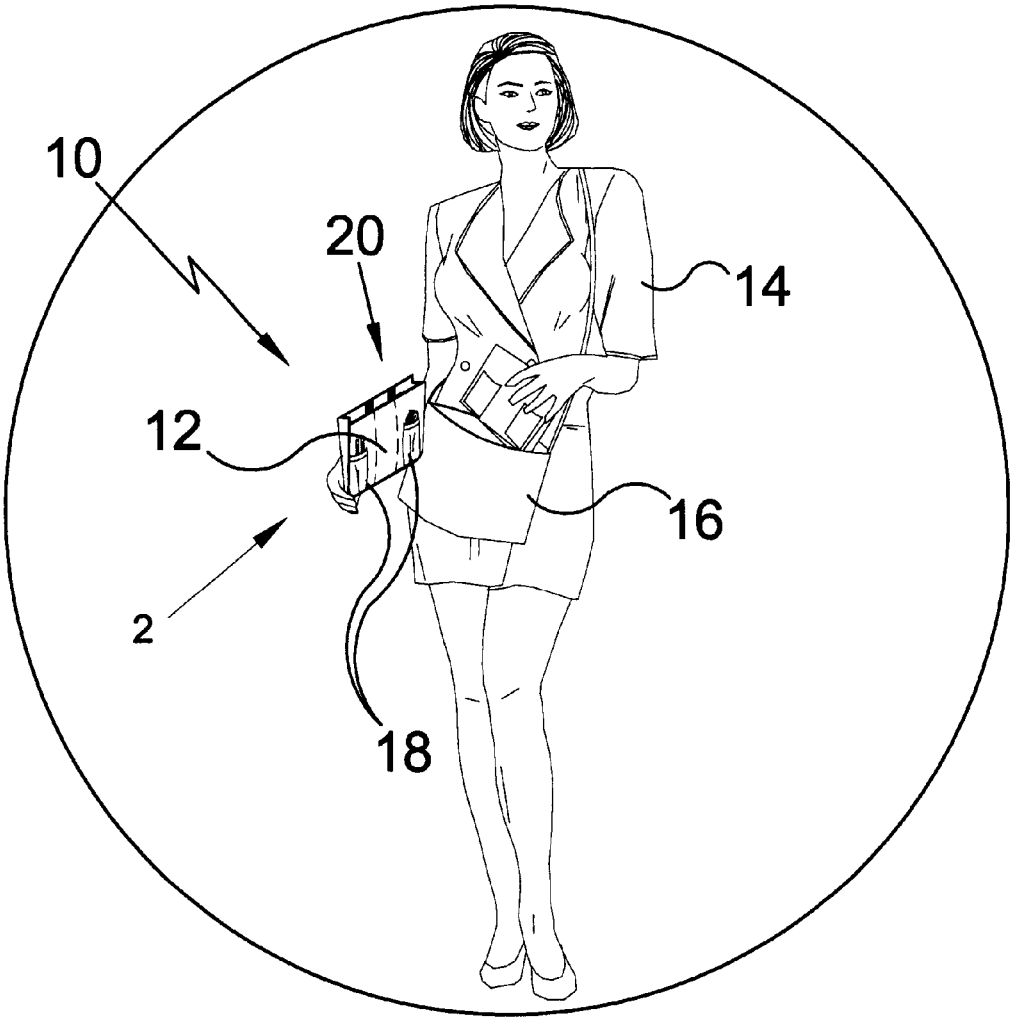
FIG. 1 is a perspective view of the present invention in use.

With regard to reference numerals used, the following numbering is used throughout the drawings.

10 present invention
12 housing
14 user
16 purse
18 outer pockets
19 gusset
20 detachable hook and loop strips
21 live hinge
22 storage area
24 non-detachable mating hook and loop strips
26 cell phone
28 calculator
30 face of detachable strip
32 face of detachable strip

DESCRIPTION OF THE PREFERRED EMBODIMENT(S)

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to appended claims.

Turning to FIG. 1, shown therein is a perspective view of the present invention 10, being a purse organizer, consisting of a portable removable rectangular-shaped housing 12 or pocket-like enclosure arranged for carrying accessories and the like. The organizer fits within the interior of the user's 14 conventional purse 16, and may carry such items as a cellular phone, calculator, wallet, check book, women's personal hygiene items and much more. Two outer pockets 18 are supplied on the exterior portion of the organizer. Detachable, movable hook and loop strips 20 are provided as section dividers with their mating, non-detachable counterparts being sewn onto opposing walls of the interior of the organizer. The partition dividers 20 are vertical elements that provide a vertical divider to define one or more storage areas.

Figure 2:
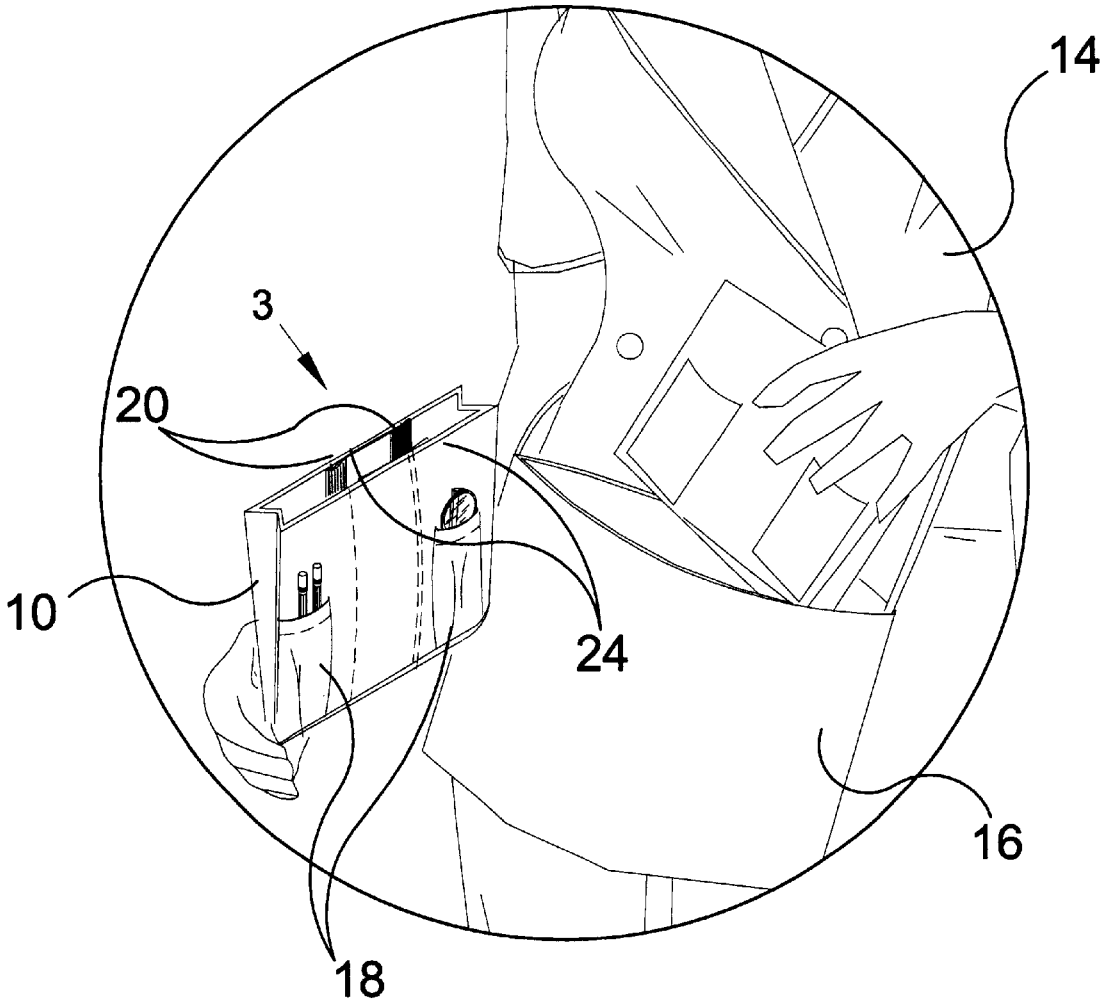
FIG. 2 is an enlarged view, taken from FIG. 1, of the present invention.

Turning to FIG. 2, shown therein are the detachable hook and loop strips 20 provided as section dividers which may be arranged to fit items according to the space required. The detachable hook and loop strips 20 are attached to their mating, non-detachable, counterparts 24 which may be sewn or adhesively attached to the interior walls of the purse organizer 10. The hook and loop strips 20 may be arranged to fit items by adjusting the positioning of the strips 20. The outer pockets 18 for holding various items, user 14, and purse 16 are also shown.

Figure 3:
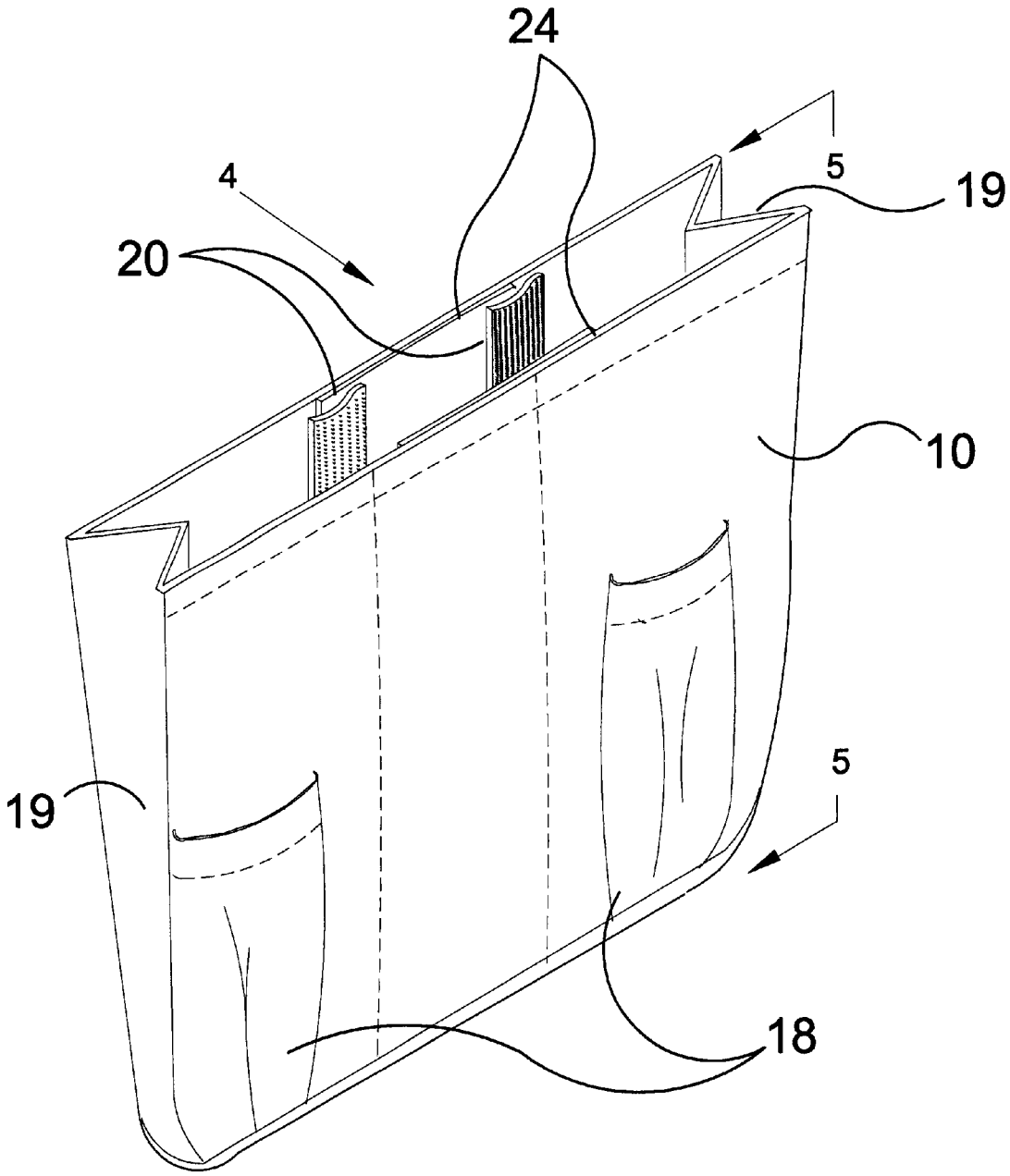
FIG. 3 is a perspective view of the present invention.

Turning to FIG. 3, shown therein are the exterior and partial interior of the purse organizer 10 of the present invention. The hook and loop detachable strips 20 are shown along with mating, non-detachable counterparts 22 sewn into the purse organizer 10. Pockets 18 are also shown along with a gusset 19 formed on the first and second ends of organizer 10.

Figure 4:
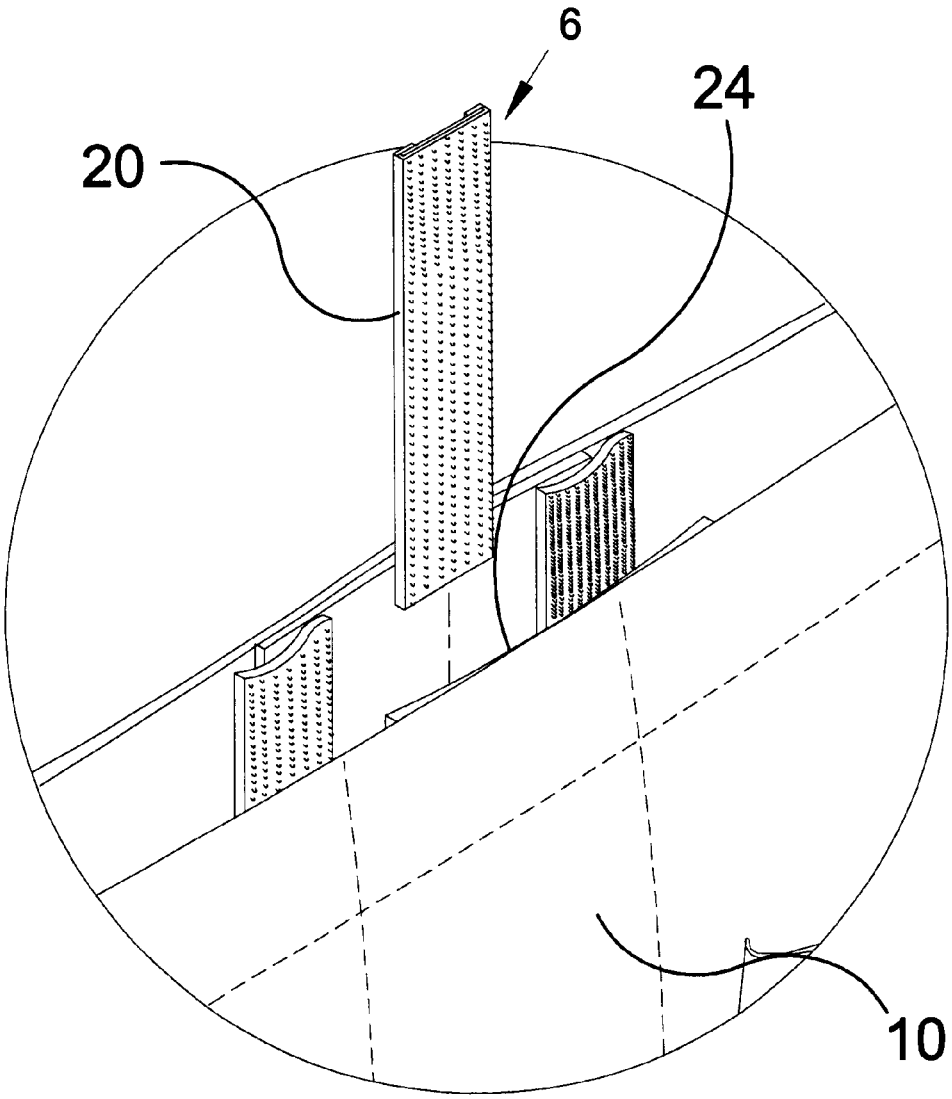
FIG. 4 is a perspective view of the present invention.

Turning to FIG. 4, shown therein are detachable hook and loop strips 20 which are provided as section dividers and are detachable and may be arranged to fit variously sized and shaped items according to space requirements. The hook and loop strips 20 are attached to their mating, non-detachable counterpart 24 which is sewn into the interior walls of the purse organizer 10. The hook and loop strips 20 may be arranged to fit various items by adjusting the positioning of the movable strips 20 onto the non-movable strips 24.

Figure 5:
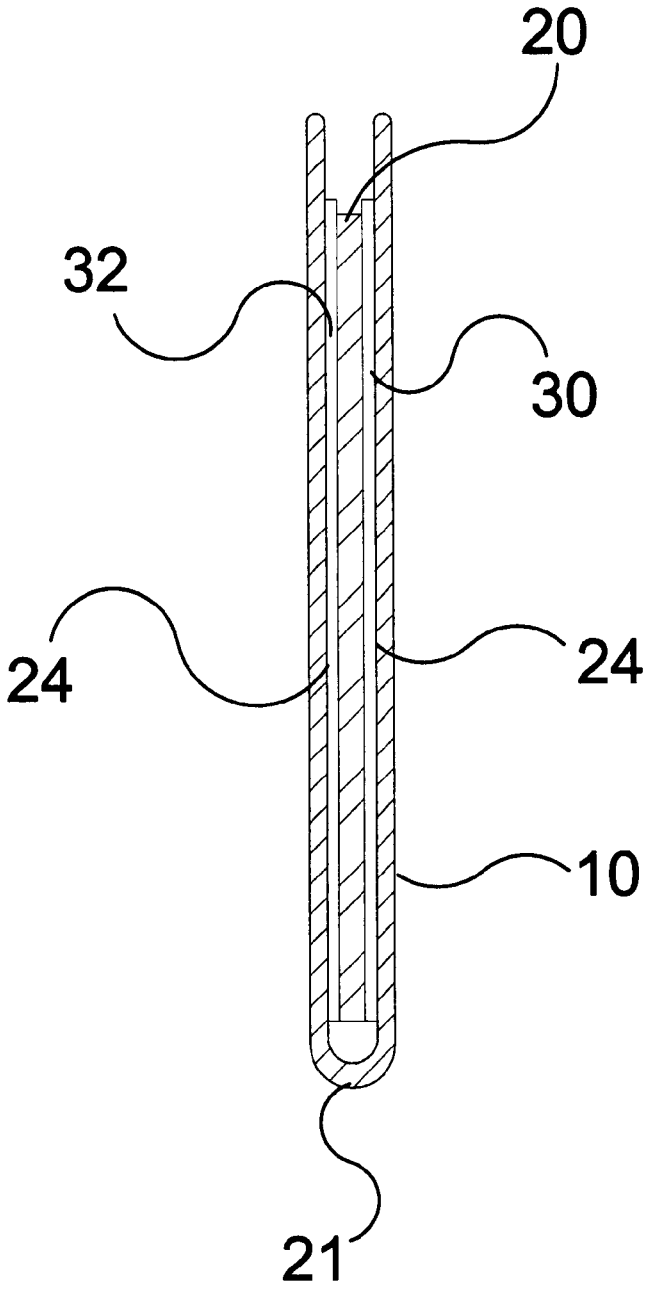
FIG. 5 is a sectional view of the present invention.

Turning to FIG. 5, shown therein are the detachable hook and loop strips 20 attached to their mating, non-movable counterparts 24 which are sewn into the interior walls of the purse organizer 10. The detachable hook and loop strips 20, with faces 30, 32 thereon, may be used one, two or three at a time, depending on the amount of space required. A live hinge 21 is also formed into the bottom of the organizer 10.

Figure 6:
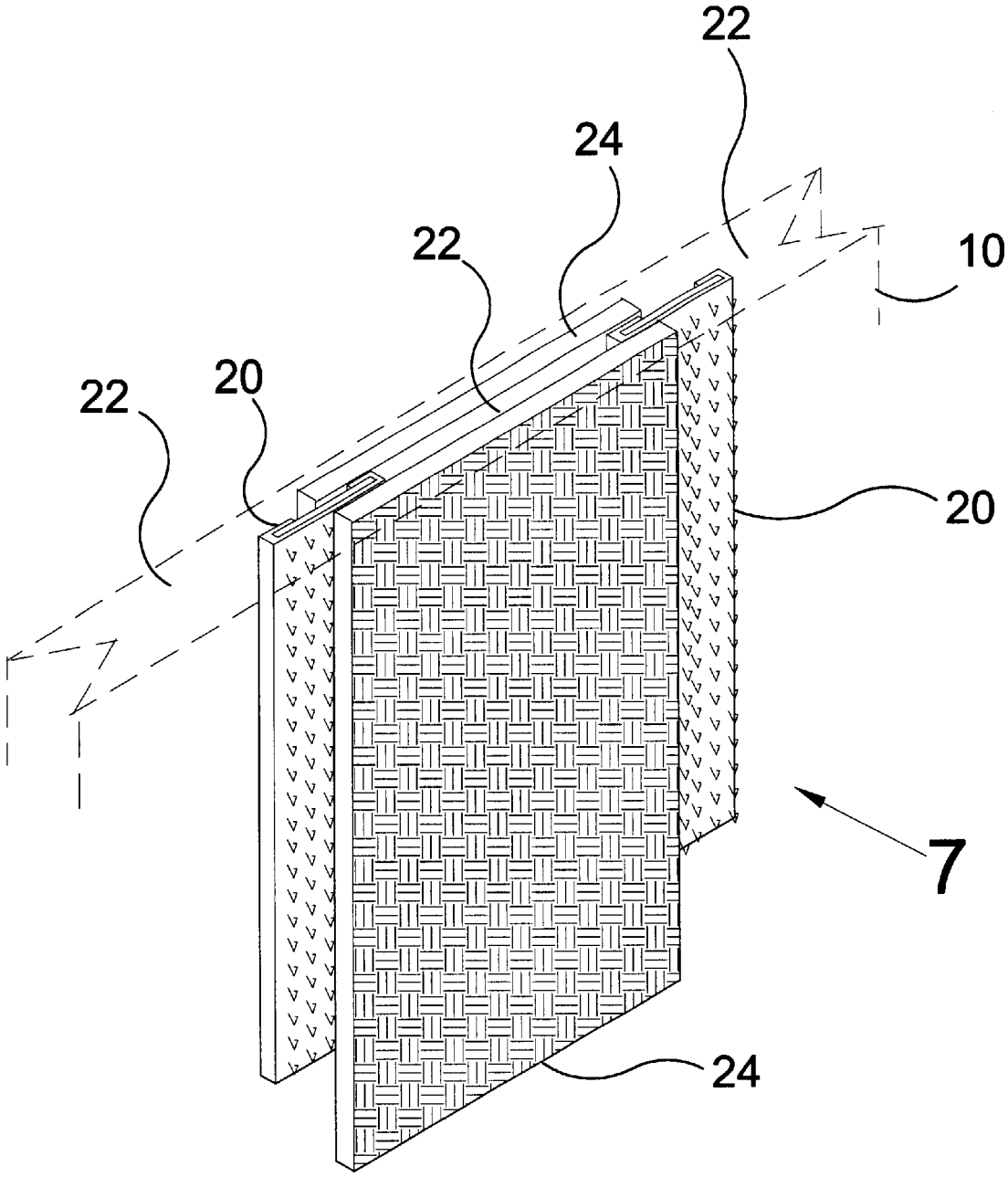
FIG. 6 is a detail view of the partition and retaining means of the present invention.

Turning to FIG. 6, shown therein is a hook and loop configuration using two detachable strips 20 to create three separate storage areas 22 within the purse organizer 10. The non-removable mating hook and loop strips 24 are also shown.

Figure 7:
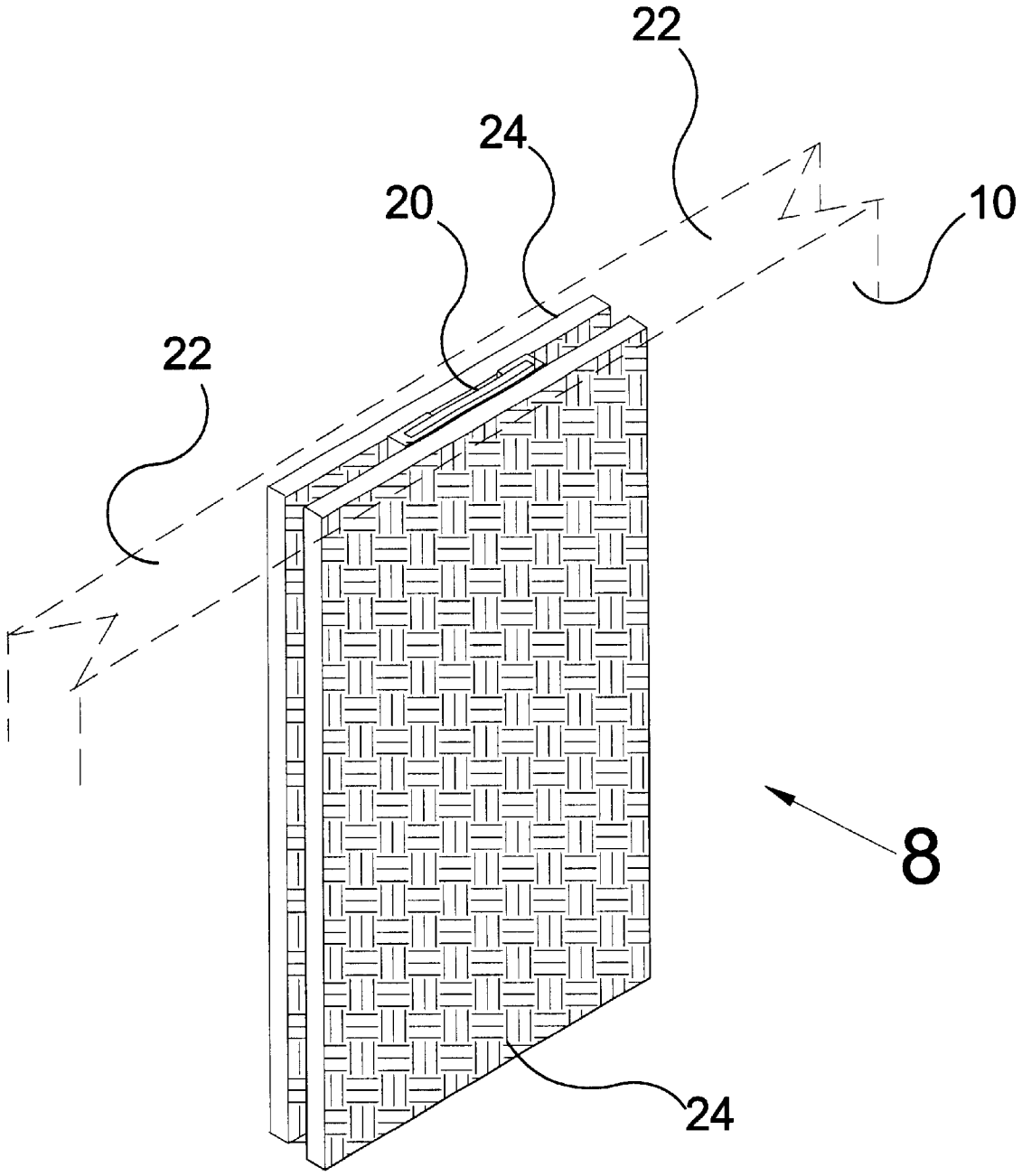
FIG. 7 is a view of the present invention installed in a purse, show in outline.

Turning to FIG. 7, shown therein is a hook and loop configuration using one detachable strip 20 to create two separate storage areas 22 within the purse organizer 10.

Figure 8:
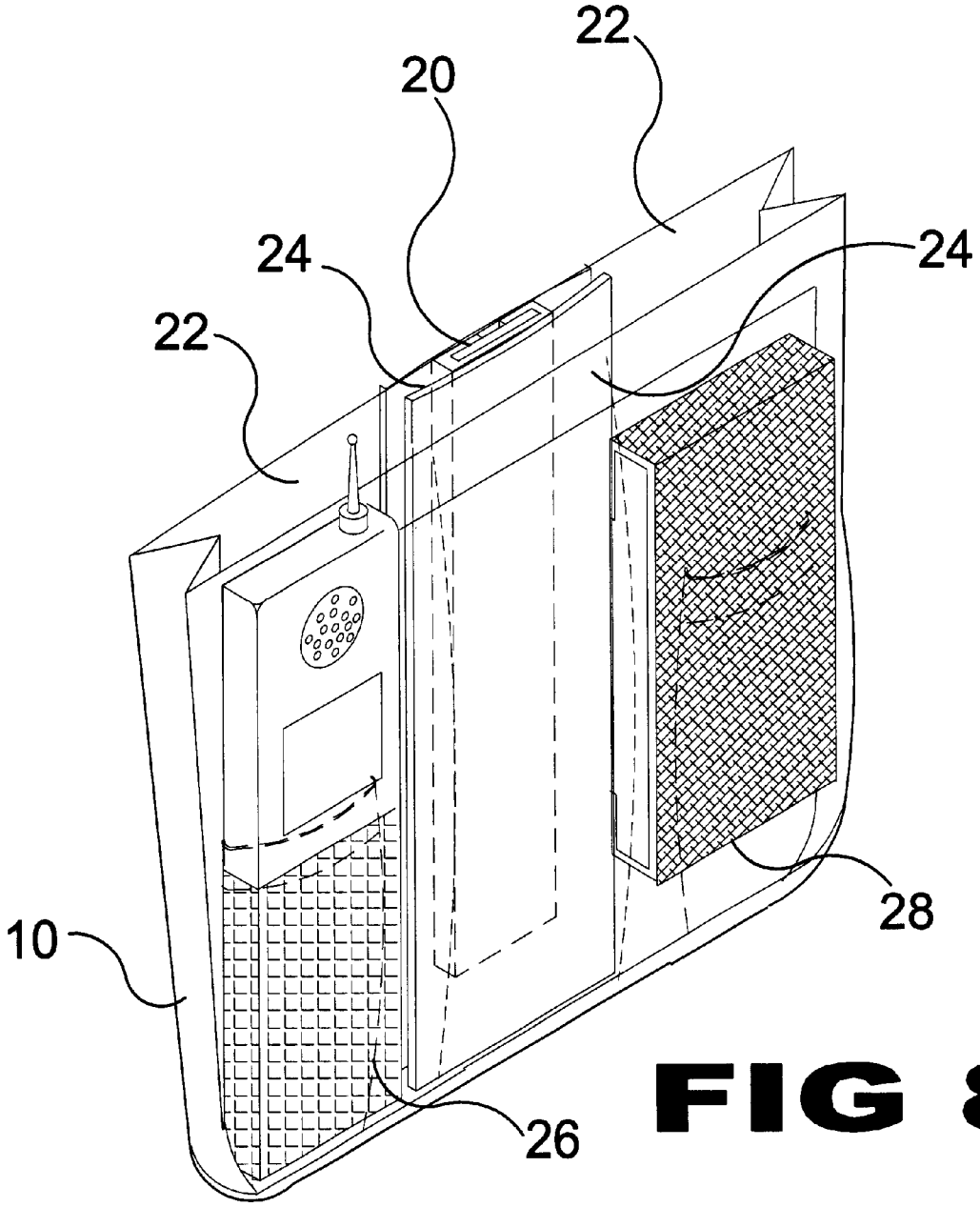
FIG. 8 is a view of the present invention, as shown in FIG. 8, having article stowed with the partitions created by the present invention.

Turning to FIG. 8, shown is the purse organizer 10 of the present invention divided into two storage areas 22. A cellular phone 26 is stored within the left division and a calculator 28 in the right division. The detachable hook and loop strip 20 is placed in the center of the mating hook and loop material 24 creating the two division.

I claim:

1. An organizer for insertion in and in combination with a purse, comprising:

a) said organizer having an enclosure, said enclosure having a first side, a second side, a top end and a bottom end, a first end and a second end, said top end of said enclosure having an opening therein;

b) a gusset disposed on each of said first and second ends so that said enclosure is expandable;

c) a live hinge formed on said bottom end of said enclosure so that said enclosure is expandable, the gussets on said first and second ends of said enclosure being narrowed down on said bottom end of said enclosure and enlarging toward the top end of said enclosure to allow for expansion of interior space within said enclosure;

d) a sheet of hook and loop material fixedly disposed on each interior of said first and second side of said enclosure, the sheets facing each other within said enclosure and extending from said top end to said bottom end of said enclosure;

e) detachable strips of mating hook and loop material removable disposed between said sheets of fixedly disposed hook and loop material to divide the interior of said enclosure into separate compartments to accommodate items to be placed into said compartments, said detachable strips running from said top end to said bottom end of said enclosure, hook and loop material on one side of each of said detachable strips curling around side edges of said strips; and, f) at least one pocket disposed on the exterior of said first side of said organizer.

* * * * *